US008439491B2

(12) United States Patent
Hayashi et al.

(10) Patent No.: US 8,439,491 B2
(45) **Date of Patent: *May 14, 2013**

(54) INK TANK

(75) Inventors: Hiroki Hayashi, Yokohama (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

This patent is subject to a terminal disclaimer.

(21) Appl. No.: 13/197,663

(22) Filed: Aug. 3, 2011

(65) Prior Publication Data

US 2011/0316945 A1 Dec. 29, 2011

Related U.S. Application Data

(62) Division of application No. 11/841,537, filed on Aug. 20, 2007, now Pat. No. 8,011,768.

(30) Foreign Application Priority Data

Aug. 23, 2006 (JP) ..... 2006-227176

(51) Int. Cl.
*B41J 2/175* (2006.01)
*B41J 2/14* (2006.01)

(52) U.S. Cl.
USPC ..... 347/86; 347/49

(58) Field of Classification Search ..... 347/49, 347/50, 85, 86, 87
See application file for complete search history.

(56) References Cited

U.S. PATENT DOCUMENTS

| | | | | |
|---|---|---|---|---|
| 4,907,018 | A | 3/1990 | Pinkerpell et al. | 346/139 |
| 5,619,237 | A | 4/1997 | Inoue et al. | 347/86 |
| 6,050,669 | A | 4/2000 | Yano et al. | 347/23 |
| 6,089,687 | A | 7/2000 | Helterline | 347/7 |
| 6,130,695 | A * | 10/2000 | Childers et al. | 347/85 |
| 6,247,598 | B1 | 6/2001 | Hosaka et al. | 206/723 |
| 6,302,535 | B1 * | 10/2001 | Sturgeon et al. | 347/86 |
| 6,371,586 | B1 | 4/2002 | Saruta et al. | 347/7 |

(Continued)

FOREIGN PATENT DOCUMENTS

| | | |
|---|---|---|
| DE | 203 21 131 | 1/2006 |
| EP | 1652679 | 5/2006 |

(Continued)

OTHER PUBLICATIONS

Extended European Search Report dated Mar. 4, 2009, from corresponding European Application No. 07114673.2.

*Primary Examiner* — Anh T. N. Vo
(74) *Attorney, Agent, or Firm* — Fitzpatrick, Cella, Harper & Scinto

(57) ABSTRACT

An ink tank provided with a supply port for supplying the ink contained therein and an electric contact for information transmission is smoothly and securely attached to an attachment section of a printing apparatus while achieving secure connection of an electric contact section at the same time. The ink tank is configured to be attachable to the attachment section by positioning a first engagement section at a first fitting section on the attachment section, and then by rotating the ink tank around the positioned first engagement section to lock a second engagement section to a second fitting section on the attachment section. The supply port and a positioning section for the contact are disposed on the bottom face of the ink tank so as to be on the respective two sides of the center line in the width direction of the ink tank therebetween.

14 Claims, 14 Drawing Sheets

U.S. PATENT DOCUMENTS

| | | | | |
|---|---|---|---|---|
| 6,390,612 | B1 | 5/2002 | Kotaki et al. | 347/85 |
| 6,419,350 | B1 | 7/2002 | Abe et al. | 347/86 |
| 6,623,104 | B1 | 9/2003 | Kotaki et al. | 347/49 |
| 6,746,110 | B2 | 6/2004 | Hayashi | 347/86 |
| 6,815,381 | B1 | 11/2004 | Yamamoto et al. | 442/187 |
| 6,827,431 | B2 | 12/2004 | Kitabatake et al. | 347/86 |
| 6,877,847 | B2 | 4/2005 | Hayashi et al. | 347/86 |
| 6,916,085 | B2 | 7/2005 | Kotaki et al. | 347/49 |
| 6,942,326 | B2 | 9/2005 | Hayashi et al. | 347/86 |
| 6,955,422 | B2 | 10/2005 | Miyazawa et al. | 347/86 |
| 6,966,631 | B2 | 11/2005 | Matsuo et al. | 347/49 |
| 6,997,548 | B2 | 2/2006 | Matsuo et al. | 347/86 |
| 7,118,194 | B2 | 10/2006 | Matsuo et al. | 347/49 |
| 7,134,747 | B2 | 11/2006 | Hayashi et al. | 347/86 |
| 7,165,829 | B2 | 1/2007 | Hayashi et al. | 347/49 |
| 7,278,721 | B2 | 10/2007 | Shimizu et al. | 347/86 |
| 7,712,884 | B2 * | 5/2010 | Silverbrook | 347/92 |
| 2005/0248637 | A1 | 11/2005 | Seino et al. | 347/86 |
| 2008/0049080 | A1 | 2/2008 | Hayashi et al. | 347/86 |

FOREIGN PATENT DOCUMENTS

| | | |
|---|---|---|
| JP | 8-58107 | 3/1996 |
| JP | 11-291518 | 10/1999 |
| JP | 2006-116786 | 5/2006 |

* cited by examiner

INK TANK

This application is a divisional of U.S. application Ser. No. 11/841,537, filed Aug. 20, 2007, the contents of which are incorporated herein by reference.

BACKGROUND OF THE INVENTION

1. Field of the Invention

The present invention relates to an ink tank, and, more specifically, to an ink tank to be employed to an inkjet printing apparatus.

2. Description of the Related Art

Along the advance of image quality of printing in recent years, commonly employed in inkjet printing apparatuses is a method of increasing the number of ink colors used for printing in order to improve the image quality targeting for photographic image quality. A method of providing multiple tanks is widely used in a desktop printing apparatus, the tanks prepared for different colors and being independently detachable. Such a configuration causes an increase in the number of ink tanks, whereby the frequency of tank replacing operations by a user is increased. Moreover, as the ink tanks are provided independently, the wall thickness of each of the ink tanks has a great influence on the size of the printing apparatus.

Accordingly, from the viewpoint of user friendliness and of downsizing printing apparatuses, ink tanks which are configured to integrate ink containers for multiple colors have been proposed.

In order to achieve stable ink supply, an ink tank provided with multiple ink supply ports corresponding to ink containers for multiple colors, needs to be attached so that the respective ink supply ports are securely fixed to a holder of the apparatus. To achieve such secure attachment, proposed is an attachment mechanism including a mounting member called a latch lever as disclosed in Japanese Patent Laid-Open No. 08-058107. Such an attachment mechanism has been applied to many types of ink tanks because the mechanism enables simple attachment and detachment of the ink tanks.

In addition, proposed is a configuration to allow an ink tank to store predetermined information concerning the ink tank such as the colors of inks contained therein, and thereby to fulfill a required function according to the information. Japanese Patent Laid-Open No. 11-291518 discloses a configuration of an ink tank including a board mounted with an information storage element and means for electrically presenting stored information. A printing apparatus is configured to read the information at the time of attaching the ink tank to perform operation control, thereby being able to achieve fine printing outputs at any time. Japanese Patent Laid-Open No. 2006-116786 discloses a configuration to establish both secure connection in an ink supply system and a fine state of connection in an information communication system between an ink tank and a printing apparatus.

FIGS. 14A and 14B are schematic cross-sectional views for explaining the configuration and operations of an ink tank attachment mechanism disclosed in Japanese Patent Laid-Open No. 2006-116786.

The ink tank includes a board 1024, which is provided with a storage element being able to store information and a contact section for communicating the information with the body. Moreover, an ink tank holder section of the body, to which the ink tank is attached, includes a contact unit 1103 provided with a contact pin, which is to be in contact with the contact section provided to the board 1024 of the ink tank. This contact unit 1103 is movable in the y directions as shown in FIG. 14A, and is biased to the position indicated in FIG. 14A by use of a spring 1017 when the ink tank is not attached.

The ink tank is provided with a fitting section 1101 for position alignment in order to accurately position the contact section for communicating the information. On the other hand, a corresponding engagement section 1102 for position alignment is provided to an attachment section (a holder) of a printing apparatus. The fitting section 1101 provided to the bottom face of the ink tank forms a substantially triangular concave section which is engageable with the engagement section 1102 of the holder.

When the ink tank is attached to the holder, the tip end of the engagement section 1102 firstly touches an end of a slope 1104 of the fitting section 1101 located on the bottom face of the ink tank, as shown in FIG. 14A. In this state, when a user presses down the upper end of the ink tank, the tip end of the engagement section 1102 slides on the slope 1104 of the fitting section 1101 and accordingly enters the concave section that forms the fitting section 1101.

When mechanical attachment is completed, electric contact sections of both of the constituents, namely, the contact section of the board 1024 of the ink tank and a contact pad included in the contact unit 1103 of the holder provided to the apparatus, come into contact with each other, thereby enabling electric connection.

Here, in terms of a configuration at the connection part between the ink tank and the printing apparatus, a contact section for an ink supply system and a contact section for an information transmission system are separately provided. Moreover, the constituent on the holder's side for the contact section for the information transmission system is rendered movable. This configuration makes it possible to establish a fine state of connection between the ink supply system and the information transmission system.

However, sealing members made of rubber are provided either around ink supply ports or around ink receiving sections on the holder's side to be connected to the ink supply ports. The sealing members are provided in order to suppress ink leakage and ink evaporation, when the ink tank is attached. The ink tank receives a reactive force from the sealing members at the time of attachment, whereby being attached while being sometimes tilted from side to side (in an orthogonal direction to FIGS. 14A and 14B). Occurrence of such a tilt of the ink tank may lead to a failure in smooth engagement of the contact section for the information transmission system at the beginning. Accordingly, there are problems that the attachment property of the ink tank may decrease, and that electric connection may be made inaccurately.

While these problems apply also to the case of an ink tank configured to contain a single-color ink, the problems are even more critical in the case of an ink tank configured to contain inks of multiple colors. This is because the ink tank configured to contain the inks of multiple colors include multiple ink supply ports disposed on the bottom face of the ink tank, and, accordingly, the reactive force caused by the rubber are increased at the time of attachment. In addition, without careful arrangement of the positions of the multiple ink supply ports, the ink tank may be attached while tilting or rolling from side to side.

SUMMARY OF THE INVENTION

The present invention is made in view of the aforementioned problems. It is an object of the present invention to achieve smooth and secure attachment (i.e. to improve the attachment property) of an ink tank and to achieve, between the ink tank and a printing apparatus, secure connection (i.e. to improve the connectivity) of a contact sections for an ink supply system as well as an electric contact section.

To attain the object, in an aspect of the present invention, there is provided an ink tank attachable to and detachable from an attachment section of an ink jet printing apparatus, the attachment section being provided with an ink receiving section, a first fitting section and a second fitting section to be engaged with the ink tank, and an electric contact, the ink tank comprising: a housing; a supply port configured to abut the ink receiving section; a tank-side electric contact being connectable to the electric contact; and a positioning section for the contact between the electric contact and the tank-side electric contact, wherein the supply port abuts, at the abutting center thereof, the ink receiving section, the supply port and the positioning section are provided on the face of the housing opposite to the ink receiving section, and are disposed on the face so that the positioning section and the abutting center of the supply port are located on the respective two sides of a line passing the center in the shorter-width direction of the face provided with the supply port of the ink tank.

In another aspect of the present invention, there is provided an ink tank attachable to and detachable from an attachment section of an ink jet printing apparatus, the attachment section being provided with a plurality of ink receiving sections, a first fitting section and a second fitting section to be engaged with the ink tank, and an electric contact, the ink tank comprising: a housing; a plurality of supply ports configured to abut the plurality of ink receiving sections; a tank-side electric contact being connectable to the electric contact; and a positioning section for the contact between the electric contact and the tank-side electric contact, wherein the plurality of supply ports abut the ink receiving sections respectively at abutting centers, the plurality of supply ports and the positioning section are provided on a face of the housing opposite to the plurality of ink receiving sections, and the positioning section and the abutting center of the supply port located closest to the positioning section among the plurality of the supply ports are disposed on the face so as to be located on the respective two sides of a line passing the center in the shorter-width direction of the face provided with the plurality of the supply ports of the ink tank.

According to the present invention, an ink supply port is disposed on the opposite side to the side where a positioning section for an electric contact is disposed, having a central axis therebetween. When the ink tank is attached to a printing apparatus, the ink tank is tilted toward the side of the positioning section for the electric contact due to a reactive force applied to an ink receiving section provided on the printing apparatus, the reactive force oriented to the opposite direction of the attachment direction and generated at the time of connecting the ink tank. As a result, the positioning section for the electric contact is smoothly engaged with a positioning section of an attachment section corresponding thereto. In this way, it is possible to improve the attachment property of the ink tank and to establish secure connection of the contact section for an ink supply system and the electric contact section.

Further features of the present invention will become apparent from the following description of exemplary embodiments (with reference to the attached drawings).

DESCRIPTION OF THE EMBODIMENTS

Hereinbelow, the present invention will be described in detail with reference to the accompanying drawings.

It is to be noted that the term "ink" in this specification is assumed to include a liquid which may be used for formation of images, designs, patterns, and the like, or for a treatment of the printing medium, or for an ink process, by means of application to a printing medium. The ink may include, for example, a liquid to used for coagulation or insolubilization of a pigment in the ink to be applied to the printing medium.

Figure 1:
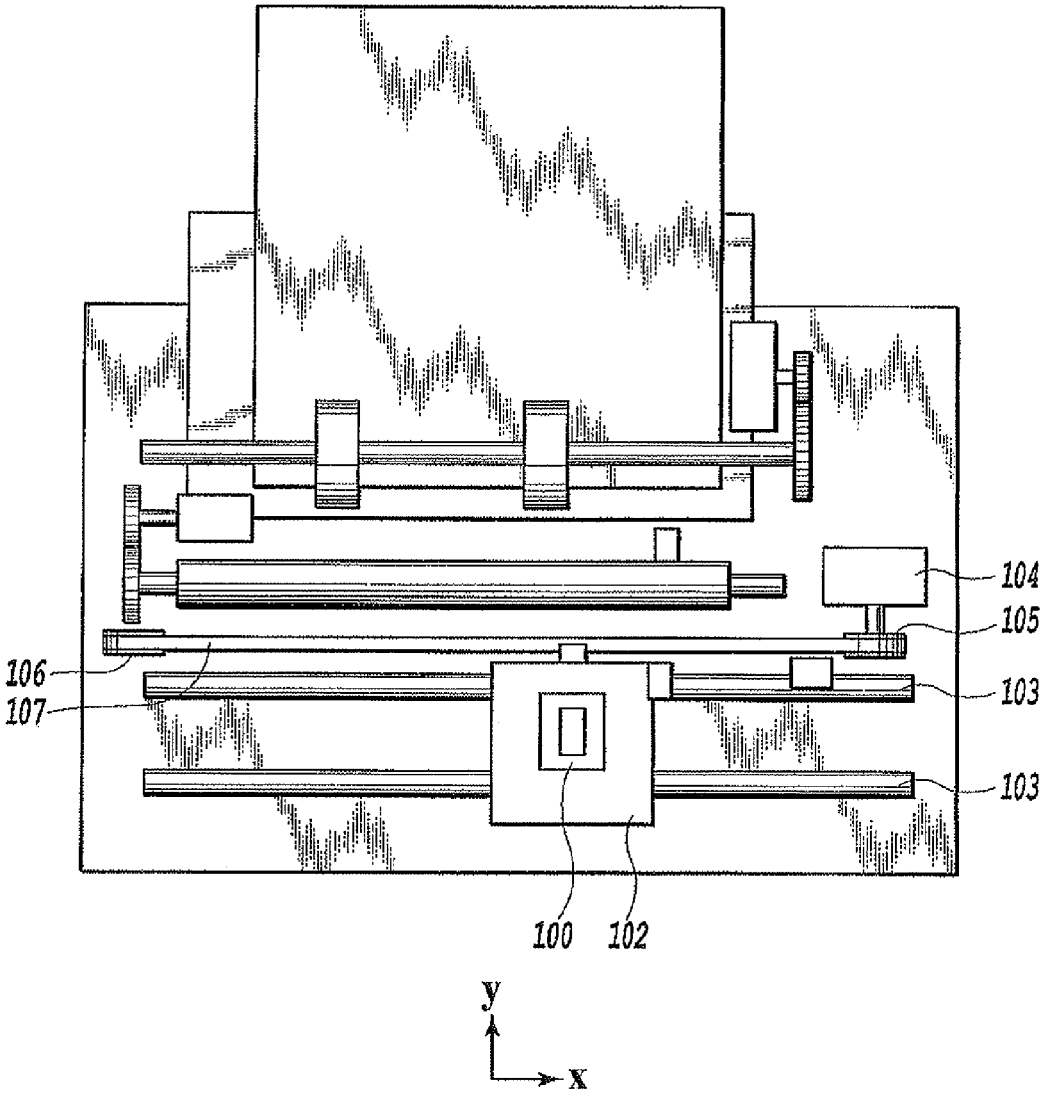
FIG. 1 is a schematic diagram showing an example of an inkjet printing apparatus to which the present invention can be applied.

FIG. 1 is a schematic diagram showing an example of an inkjet printing apparatus to which the present invention can be applied.

In FIG. 1, an ink tank attachment section 100 is positioned and mounted on a carriage 102. The carriage 102 is guided and supported so as to be able to reciprocate in x directions along a guide shaft 103 which is disposed on an apparatus body so as to extend in a main scanning direction. Moreover, the carriage 102 is driven by a main scanning motor 104 though transmission mechanisms including a motor pulley 105, a driven pulley 106, and a timing belt 107. At the same time, the position and movements of the carriage 102 are controlled by these constituents.

Figure 2A:
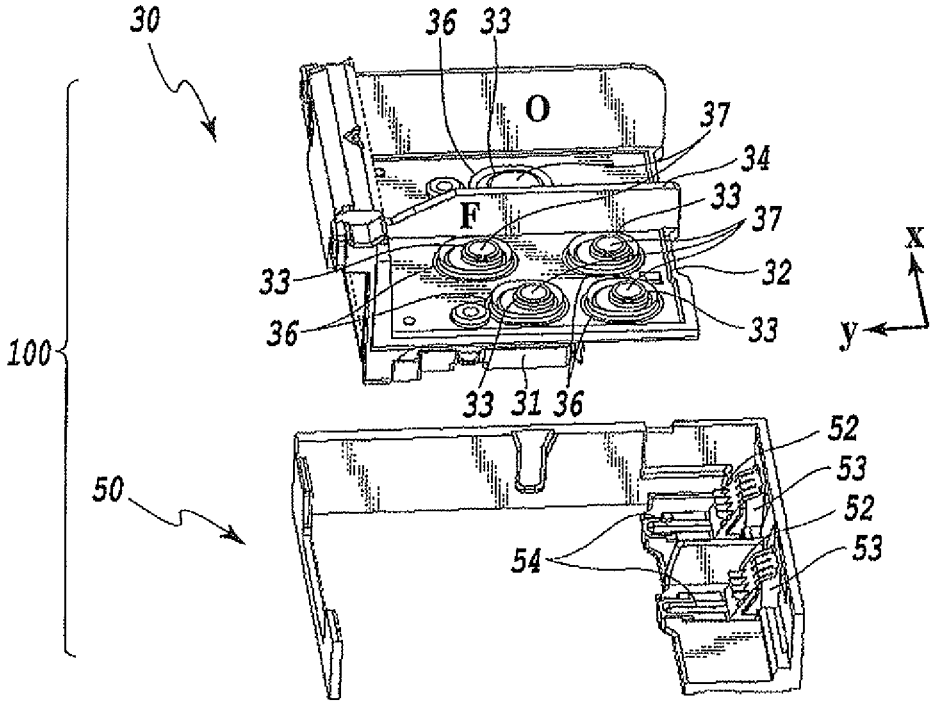
FIG. 2A is a perspective view showing a configuration example of an attachment section for attaching an ink tank according to a first embodiment of the present invention.
Figure 2B:
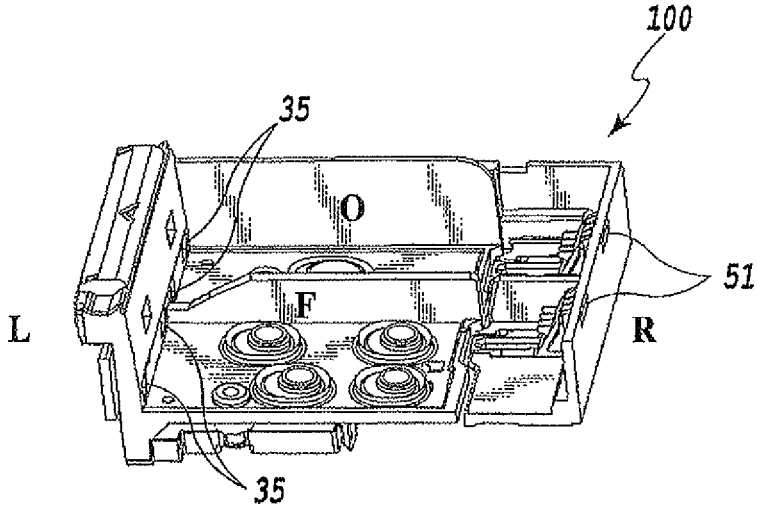
FIG. 2B is a perspective view showing a state of integrating a holder unit and a head unit which collectively constitute the configuration of the attachment section.

FIGS. 2A and 2B are perspective views showing a configuration example of the ink tank attachment section 100. The ink tank attachment section 100 includes a holder unit 50 and a head unit 30. FIG. 2A shows a state where these units are not attached to each other while FIG. 2B shows a state where these units are attached to each other. In FIGS. 2A and 2B, illustration of the side walls on one side (on the front side in the drawings) of the units are omitted in order to clarify configurations thereof. The omitted side walls are positioned on the left side when viewed from the y direction which is orthogonal to the x direction. Here, the description will be made herein on the example that the holder unit 50 and the head unit 30, constituting the ink tank attaching unit 100, are separately provided. However, the holder unit 50 and the head unit 30 may be integrated.

The holder unit 50 is mounted on the carriage 102. Moreover, the head unit 30 is attached to the holder unit 50. In this way, an inkjet head is fixed to the printing apparatus body, and the ink tank attachment section 100 is accomplished. The ink tank attachment section 100 may be configured so that the holder unit 50 is attached to the carriage either non-detachably or detachably while the head unit 30 is detachably attached to the holder unit 50.

The head unit 30 includes an inkjet head 31, which has nozzles for ejecting ink arrayed in a direction different from the x direction, or in the y direction, for example. The inkjet head 31 is integrally provided in a position defined as a bottom section of a head holder 32. Multiple nozzle arrays are prepared so as to correspond to the number of ink colors used therein. In this embodiment, the inkjet head 31 is assumed to include the nozzle arrays for the inks corresponding to respective colors of black, cyan, magenta, yellow, and photo black.

A black ink tank 10*a* for containing a black ink is attached to the head unit 30 on the back side (on the right side viewed from the y direction) indicated with "O" in FIG. 2A. A color ink tank 10*b* containing color inks for four colors of cyan, magenta, yellow, and photo black is attached to the front side (on the left side viewed from the y direction) indicated with "F" in FIG. 2A. A partition wall 34 is integrally provided on the bottom wall of the head unit 30 in order to divide regions for attaching these ink tanks 10*a* and 10*b* shown in FIGS. 3A and 3B. In the following, these ink tanks will be collectively designated by reference numeral 10 when it is not necessary to discriminate these two ink tanks. This partition wall 34 includes a gentle slope configured to reduce its level gradually in the y direction, which is the direction for inserting the ink tank.

Ink receiving pipes 33 corresponding to ink supply ports 14 for the respective colors provided to an ink tank 10 to be described later are formed in a protruding manner on the head unit 30. That is, a single-ink receiving pipe for the black color is formed on an attachment section for the black ink tank 10*a* while four-ink receiving pipes corresponding to cyan, magenta, yellow, and photo black are formed on an attachment section for the color ink tank 10*b*. Moreover, the respective ink receiving pipes 33 communicate, through unillustrated ink supply passages, with the nozzles prepared for the inks of the respective colors.

A sealing member 36 made of an elastic material, such as rubber, is attached around each of the ink receiving pipes 33. This sealing member 36 is configured to cover a surrounding area of each of the ink supply ports 14 when the ink tank 10 is attached, thereby retaining a hermetically sealed state of an ink supply system and preventing leakage and evaporation of the ink. A filter 37 for preventing invasion of foreign bodies, including dusts and bubbles, into the ink receiving pipe 33 is disposed to an end face of each of the ink receiving pipes 33.

At the time of an operation to attach the ink tank 10, an attachment guide section 15 of the ink tank 10 is allowed to slide on the partition wall 34. In this way, the ink tank 10 is guided so as not to contact the ink receiving pipes 33. Hence, the partition wall 34 also functions as a breakage prevention guide for the ink receiving pipes 33 at the time of the operation to attach the ink tank 10.

FIG. 2B shows a state in which the head unit 30 and the holder unit 50 are integrated. Two of first fitting sections 35 functioning as hinges at the time of the operation to attach the ink tank and as fixation sections for the respective ink tank at the time of attachment are provided for each of the regions divided by the partition wall 34 on the back side in the y direction of the head unit 30 (i.e. on the left side in FIG. 2B) indicated with "L" in FIG. 2B. In this embodiment, the first fitting sections 35 are formed into concave sections while engagement sections (first engagement sections 22) provided to corresponding positions on the ink tank 10 are formed into convex sections so that these constituents can be coupled together. The above-described relation of concavity and convexity may, however, be inverted.

A single second fitting section 51 for fixation at the time of attaching each of the ink tanks 10 is provided on the front side in the y direction of the holder unit 50 (the right side in the drawing) indicated with "R" in FIG. 2B. Each of the second fitting sections 51 is also formed into a concave shape, and can be coupled with an engagement section (a second engagement section 23) formed into a convex shape in a corresponding position of the ink tank 10.

The holder unit 50 includes contact units 53 respectively provided with contact pins 52 to be electrically connected to memory elements of the ink tank 10 to be described later. The contact units 53 are connected to a control unit of the printing apparatus body through unillustrated cables. In the attached state of the ink tank 10, it is possible to communicate data between the control unit of the printing apparatus body and the memory elements of the ink tank through the contact units 53.

Next, a configuration of the ink tank will be described.

Figure 3A:
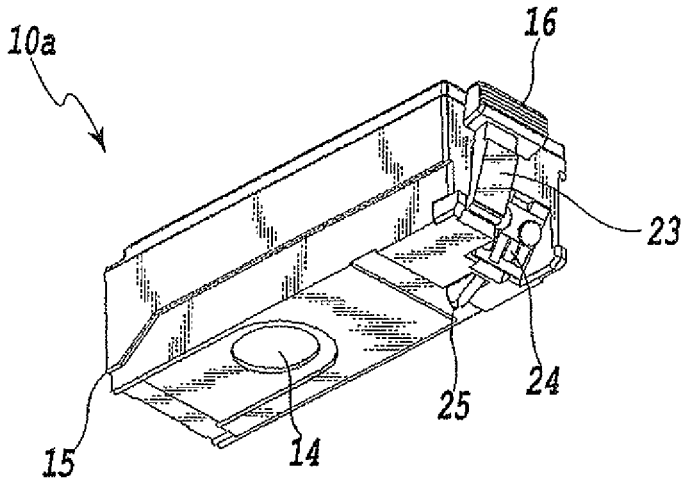
FIG. 3A is a perspective view of showing a configuration of a black ink tank according to the first embodiment, viewed from the direction of the bottom face thereof.
Figure 3B:
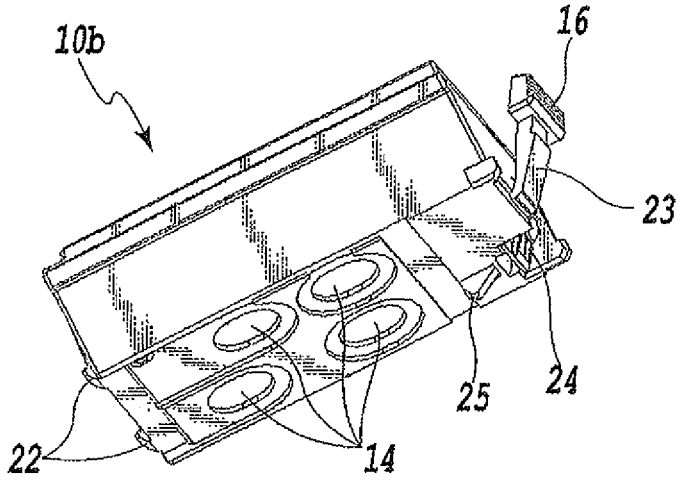
FIG. 3B is a perspective view of showing a configuration of a color ink tank according to the first embodiment, viewed from the direction of the bottom face thereof.
Figure 4:
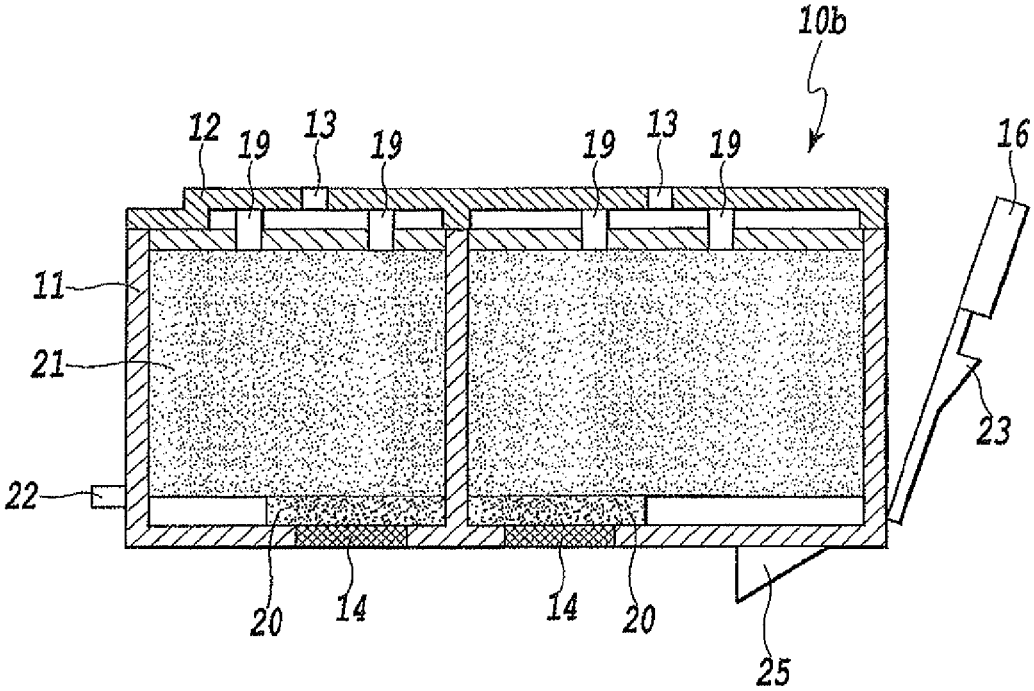
FIG. 4 is a cross-sectional view of the color ink tank according to the first embodiment.
Figure 5:
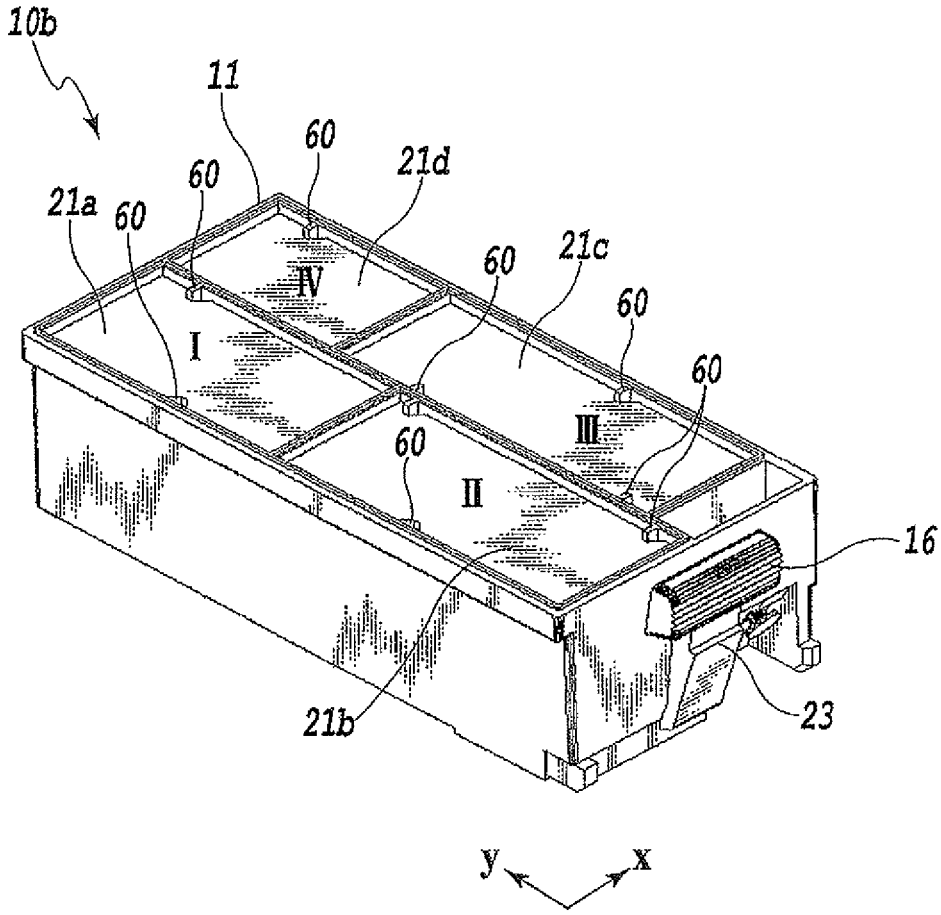
FIG. 5 is a perspective view for explaining an internal configuration of the color ink tank according to the first embodiment.

FIGS. 3A and 3B are perspective views of configuration examples of the black ink tank 10*a* and the color ink tank 10*b* which are respectively viewed from a direction of bottom faces. Meanwhile, FIG. 4 is a schematic cross-sectional view of the color ink tank 10*b*, and FIG. 5 is a perspective view of the color ink tank 10*b* showing a state of taking a lid off in order to explain the internal configuration thereof.

The ink tanks 10*a* and 10*b* basically have the same internal structure except a difference in the number of colors of the inks to be contained. Hence, the color ink tank 10*b* will be described here as the example.

The ink tank generally includes a housing 11 having an upper end face formed into an opening and a lid member 12 for occluding the opening of the housing 11. These constituents collectively define ink containers. The lid member 12 includes air communication ports 13 for guiding air into the ink tank, and ribs 19 which are structures for forming buffering spaces for preventing ink leakage out of the air communication ports 13 in the event of an environmental change. First ink retaining members 20 for ink supply and second ink retaining members 21 for impregnating and retaining the yellow, magenta, cyan, and photo black inks and are housed in spaces of the respective ink containers.

The configuration will be described more concretely by using FIG. 5. The second ink retaining members 21*a*, 21*b*, 21*c*, and 21*d* are disposed counterclockwise from the positon indicated by 'I' in the drawing. These respectively impregnate and retain the cyan, yellow, magenta, and photo black inks. Moreover, as the ribs 19 protrude inward in the ink containers, the buffering spaces are secured between the second ink retaining members 21*a* to 21*d* and the lid member 12. Meanwhile, ribs 61 for forming air paths are provided from the bottom face to the lid of the ink tank so as to enhance reliability against the ink leakage by eliminating occluded air space inside the tank.

FIG. 4 is a cross section of the ink tank taken along the ink containers for the cyan and yellow ink. Here, the inside of the tank is divided into two sections.

On the bottom face of the housing 11, the ink supply ports 14 for ink supply are located in positions corresponding to the ink receiving pipes 33 formed on the head unit 30. In spaces between the second ink retaining members 21 and the bottom wall of the ink tank, the first ink retaining members 20 are disposed to closely contact to the second ink retaining members 21 and to occlude the ink supply ports 21 from inside.

While both of the first ink retaining member 20 and the second ink retaining member 21 are configured to impregnate and retain the ink, an ink retaining force (a capillary force) of the first ink retaining member 20 is rendered higher than an ink retaining force of the second ink retaining member 21. In this way, the ink retained in the second ink retaining member 21 is efficiently guided to the first ink retaining member 20, and consumption efficiency of the ink retained in the second ink retaining member 21 is thereby improved.

In the ink tank of this embodiment, ink capacities are set as described below in light of usage frequencies of the respective colors of inks:

magenta ink capacity=yellow ink capacity

>cyan ink capacity>photo black ink capacity

In FIG. 5, the cyan ink is filled in a section I, the yellow ink is filled in a section II, the magenta ink is filled in a section III, and the photo black ink is filled in a section IV. Since the capacities of the respective colors of the inks satisfy the foregoing expression, when the partitions inside the housing are observed from above the ink tank, it is apparent that the partition walls are not forming an intersection of two straight lines . Instead, as shown in FIG. 5, the partition wall between the cyan and yellow ink containers (the wall between the sections I and II) and the partition wall between the magenta and photo black ink containers (the wall between the sections III and IV) are arranged so as to form a step.

In this embodiment, the ink retaining members 20 and 21 are formed by use of fiber assemblies that are made of polyolefin-based thermoplastic resin. In addition, the housing 11 and the lid member 12 are also made of a polyolefin-based thermoplastic resin material similar to the ink retaining members. Therefore, it is possible to improve recycling efficiency and reuse efficiency and thereby to offer the environment-friendly ink tank.

A latch lever 16 includes the second engagement section 23 which is formed into a protrusion so as to correspond to the second fitting section 51 for ink tank fixation provided on the holder unit 50. Moreover, first engagement section 22 formed into protrusions so as to correspond to first fitting sections 35 for ink tank fixation are provided on an opposite face with the latch lever 16.

Figure 6A:
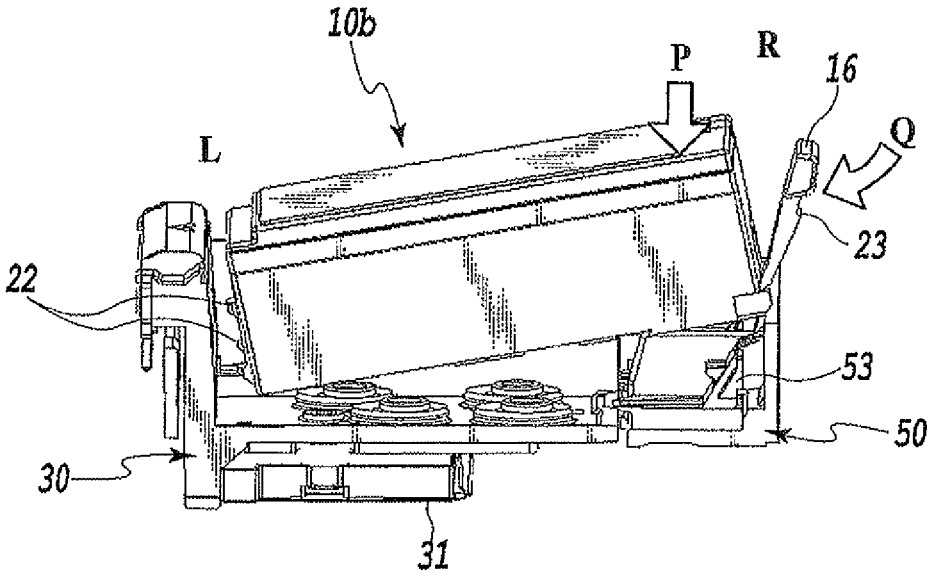
FIG. 6A is a perspective view for explaining an operation of attaching the ink tank according to the first embodiment.

In this embodiment, the first engagement sections 22 are provided to two positions on the face on the back side in the direction of inserting the ink tank, which is the side indicated as "L" of the tank shown in FIG. 6A. In addition, the latch lever for the ink tank including the second engagement section 23 is provided to a position near the center of the opposite face to the face on the back side of the ink tank. The latch lever is provided on the face on the side of the tank indicated with "R" in FIG. 6A. The respective engagement sections for tank attachment are arranged on a triangular plane as defined by the two first engagement sections 22 and a base section on the tank side of the latch lever 16. In the following description, the face of the ink tank provided with the latch lever 16 will be referred to as the front face.

Hereinbelow, further description will be made with reference to the ink tanks shown in FIGS. 3A and 3B.

A bevel is formed in the regions beside a base of the latch lever 16 within a corner area where the bottom face of the ink tank 10 meets the front face thereof. Moreover, a board 24, which is provided with an information storage medium and a contact pad (not shown) that constitutes a contact for achieving electric connection with a contact pin provided on the holder unit, is attached to this bevel. Furthermore, a board attachment positioning section 25 is located on the bottom face of the ink tank close to the position for fitting the board 24.

When the ink tank 10 is attached to the inkjet printing apparatus, contents stored in the information storage medium can be provided to the inkjet printing apparatus. The stored contents may be information to be provided for achieving necessary management in relation to the ink tank including expiration dates of the ink, amount of ink inside the ink tank, and colors of the inks, for example. By using the information, it is possible to prompt a user to replace the ink tank by notifying the expiration date to a user and thereby to forestall printing errors due to discoloration or thickening of the ink. Moreover, by detecting correct attachment of the ink tank through a success or a failure of information communication, it is possible to prevent printing errors attributed to incomplete attachment of the ink tank.

The information storage medium may apply various aspects including a magnetic medium, a magneto-optical medium, an electric storage medium, a mechanical switch such as a dual in-line package (DIP) switch, and the like as long as such a medium can offer the information by means of mechanical contact with a contact section on the inkjet printing apparatus. For example, it is possible to apply a flash memory or to apply a write-at-once type magnetic medium. Alternatively, it is possible to apply an electrically erasable programmable read-only memory (EEPROM) when it is desirable that the printing apparatus be able to add, modify or delete information. The information may includes information on ink residual amounts or ink consumption amounts based on measurement of image data.

Next, the aforementioned operation to attach the ink tank to the printing apparatus body will be described.

Figure 6B:
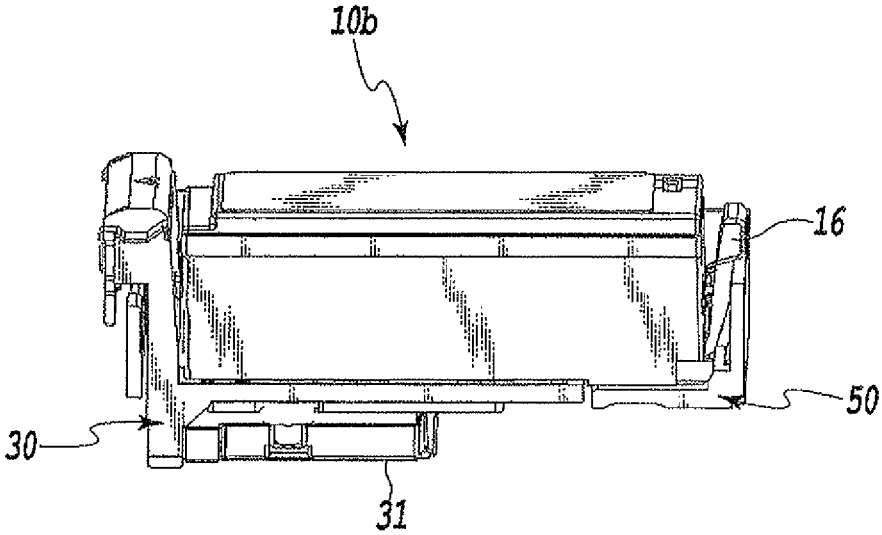
FIG. 6B is a perspective view showing a completed state of attachment of the ink tank according to the first embodiment.

FIGS. 6A and 6B are perspective views for explaining the operation to attach the ink tank. To begin with, the ink tank 10 is placed on the head unit 30 and the holder unit 50 so as to face the first engagement sections 22 formed as the protrusions provided on the ink tank 10 with the first fitting sections 35 formed as the holes on the head unit 30.

In this state, when an upper face of the ink tank 10 is pressed in a direction indicated with an arrow P in FIG. 6A, the latch lever 16 is displaced resiliently in a direction indicated with an arrow Q. Then, the ink tank 10 is displaced downward while pushing the first engagement sections 22 on the ink tank into the first fitting sections 35 provided on the head unit 30.

In the last stage of the attachment operation, as shown in FIG. 6B, the first engagement sections 22 are engaged with the corresponding first fitting sections 35 on the head unit and the second engagement section 23 is engaged with the corresponding second fitting section 51 on the holder unit. That is, the ink tank 10 is locked in three positions of the two first fitting sections 35 and the single second fitting section 51, and the mechanically locked state is therefore completed. As a consequence, it is possible to supply the ink inside the ink tank to the nozzles of the inkjet head through the ink receiving pipes and the ink supply passages.

In the process of the attachment operation, the guide section 15, shown in FIG. 3A, formed on the ink tank 10 slides on the partition wall 34 of the head unit, whereby a drop of the ink tank 10 into the attachment section is restricted. In the case of the color ink tank 10*b* shown in FIG. 3B, the guide section is not illustrated in the drawing because the guide section is located on the back side in this drawing. However, the structure of the guide section is the same as the guide section 15 located on the black ink tank 10*a* shown in FIG. 3A. By using these guide sections 15, it is possible to avoid contact of the ink tank with the ink receiving pipes 33 and to realize smooth attachment of the ink tank while preventing breakage of the head. In this embodiment, the partition wall 34 between the attachment sections for the black ink tank and the color ink tank is used in common as the guide for attaching these ink tanks. Here, concerning a tumble of each the ink tank toward the direction of the side face where the guide section is not present, it is possible to restrict such a tumbling motion or rolling by use of side walls of the head unit and the holder unit opposed to the side faces.

Next, a structure for positioning the board at the time of attaching the ink tank will be described below by using FIGS. 7A to 7C.

When attaching the ink tank, a reactive force associated with touch of the board 24 of the ink tank on the contact unit 53 of the holder unit 50 occurs. If the reactive force is transmitted to the attachment section of the ink tank, there is a risk of deviation of a position to attach the ink tank or a position to attach the inkjet head to the body. Accordingly, in this embodiment, the contact unit 53 is provided separately from the holder unit so as not to transmit the reactive force, which is incurred by touch of the contact unit 53 on the board 24, to the positioning engagement sections and the like. To be more precise, the board attachment positioning section 25 formed as the protrusion provided near the board 24 of the ink tank 10 is engaged with a positioning section on the contact unit 53 so as to determine a layout between the board and the contact unit independently of positioning a point of attachment of the ink tank itself.

A mechanism (hereinafter referred to as a board positioning mechanism) to achieve the above-described configuration will be described more in detail.

Figure 7A:
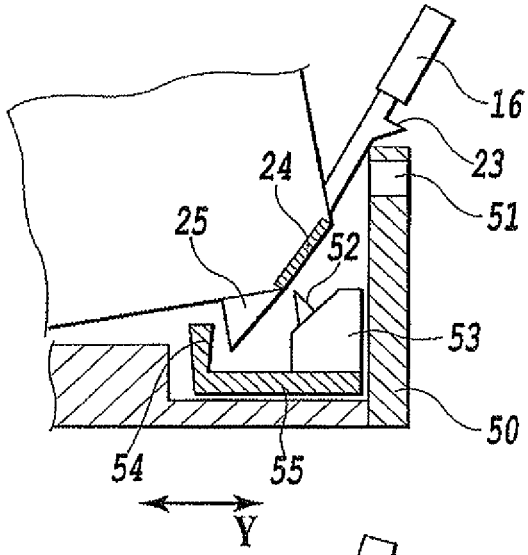
FIG. 7A is a schematic diagram of a mechanism to position a board provided to the ink tank according to the first embodiment.
Figure 7B:
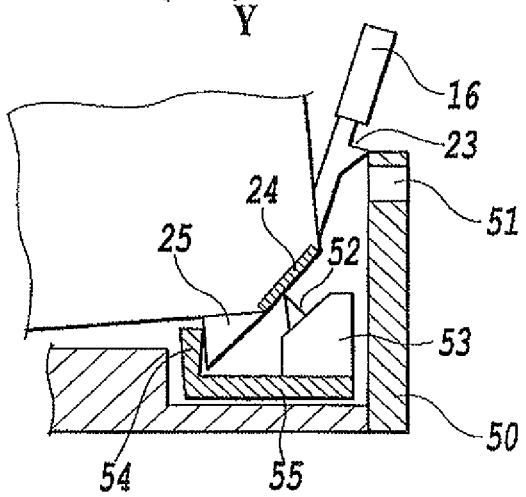
FIG. 7B is an explanatory schematic diagram at the time of attaching the ink tank according to the first embodiment.
Figure 7C:
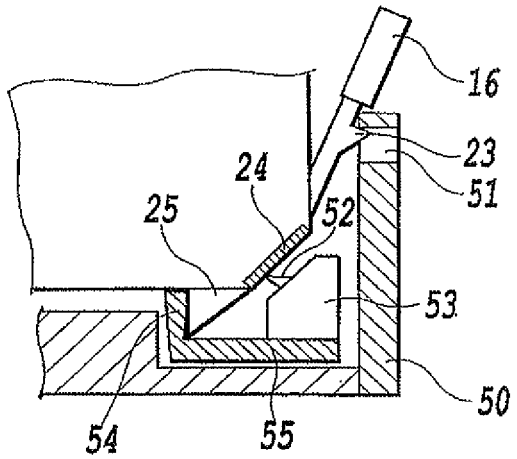
FIG. 7C is a schematic diagram in a completed state of attachment of the ink tank according to the first embodiment.

FIGS. 7A to 7C are schematic diagrams for explaining the configuration of the board positioning mechanism and for explaining sequential operations to attach the ink tank.

First, as shown in FIG. 7A, the convex board attachment positioning section 25 protrudes downward from the bottom face of the ink tank. This board attachment positioning section 25 forms a substantially triangular convex section engageable with a board-contact positioning section 54 provided on the holder unit 50 to be described later. Specifically, the board attachment positioning section 25 includes a slope configured to increase its level relative to the bottom face of the ink tank, from a region in the vicinity of the board.

On the other hand, the board-contact positioning section 54 provided on the holder unit on the printing apparatus body is formed of a base member 54 which includes a concave section which is configured to be engaged with the convex section of the board attachment positioning section 25, and the contact unit 53 is integrally provided on this base member 55. The board-contact positioning section 54 and the base member 55 are supported movably in a horizontal direction relative to the holder unit 50, and an unillustrated flexible cable for electrically connecting the printing apparatus body to the contact unit is mounted thereon. Here, the board-contact positioning section 54 may be urged toward a position shown in FIG. 7A (a position biased toward the holder unit 50) by use of an unillustrated spring when the ink tank is not attached.

As shown in FIG. 7B, in the process of the attachment operation of the ink tank 10, a tip end of the board attachment positioning section 25 provided to the tank firstly abuts an end of the board-contact positioning section 54 provided on the holder unit 53. In this state, when a user presses the upper end of the front face of the ink tank 10 in the P direction shown in FIG. 6A, the ink tank 10 positions the first engagement sections 22 of the ink tank at the first fitting sections 35, and the ink tank 10 is thereby rotated downward about the section where the first engagement sections 22 and the first fitting sections 35 are engaged. The board attachment positioning section 25 and the board-contact positioning section 54 move toward the back side in the direction of attaching the ink tank (i.e. toward the left side in FIG. 7B) while maintaining the abutment.

Accordingly, the board 24 provided on the bottom face of the tank gradually approaches the contact pins 52. Then, as shown in FIG. 7C, the positioning between the board 24 and the contact unit 53 is completed at the time of completion of attaching the ink tank. In this way, it is possible to establish electric connection between these constituents. In this state, the reactive force due to touch of the board with the contact pins of the contact unit is received at an engaged section between the board attachment positioning section 25 and the board-contact positioning section 54. The board-contact positioning section 54 is rendered freely movable in the Y direction shown in FIG. 7A. After the contact between board-contact positioning section 54 and the board attachment positioning section 25 is established, the base member 55 moves to the left side in FIG. 7C in association with the attachment operation of the tank. The reactive force attributable to the operation of contact between the contact pins and the board is absorbed by the base member 55 and the contact unit 53 which are movable relative to the holder unit 50. Accordingly, the reactive force does not have an impact on the ink tank or a head unit fixation mechanism.

Next, layouts of the ink supply ports and the board attachment positioning section of the ink tank constituting a characteristic feature of this embodiment will be described in detail.

Figure 8:
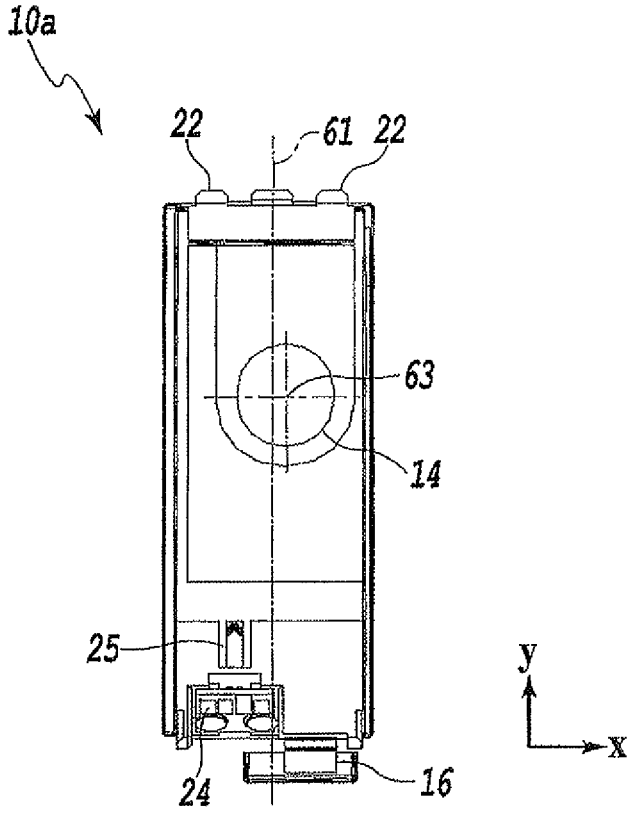
FIG. 8 is a bottom view of the black ink tank according to the first embodiment.

FIG. 8 is a bottom view of the black ink tank 10*a* of this embodiment.

A supply port for the contained black ink is provided on the bottom face of the black ink tank 10*a*. An abutting center when the ink receiving pipe 33 abuts this supply port 14 is designated by reference numeral 63, and is indicated as an intersection of broken lines in the drawing. As apparent from FIG. 8, the ink supply port 14 is formed into an oblong shape extending in the direction of tank insertion (the y direction) relative to the abutting center. In this way, it is possible to avoid the ink receiving pipe from contacting the tank bottom face wall at the time of an operation to attach or detach the ink tank.

Then, the abutting center of the ink supply port 14 is located near the back side in the direction of inserting the tank compared to the board attachment positioning section 25. At the same time, the abutting center is disposed on the opposite side of the board attachment positioning section 25, having a center line 61 in the width direction of the ink tank therebetween. Specifically, the abutting center of the ink tank 14 is located on the right side, and the board attachment positioning section 25 is located on the left side of the drawing, while having the center line 61 in-between. By applying this layout, the ink supply port 14 receives the reactive force from the ink receiving pipe 33 and the sealing member 36 around the ink receiving 33 prior to the contact between the board 24 and the contact unit 53 at the time of the operation to attach the ink tank. Accordingly, the ink tank 10*a* is tilted to the left side relative to the center line 61 in FIG. 8 where the abutting center is not located.

An advantage of the operation to attach the ink tank involving such a tilt will be described below in detail.

Figure 9A:
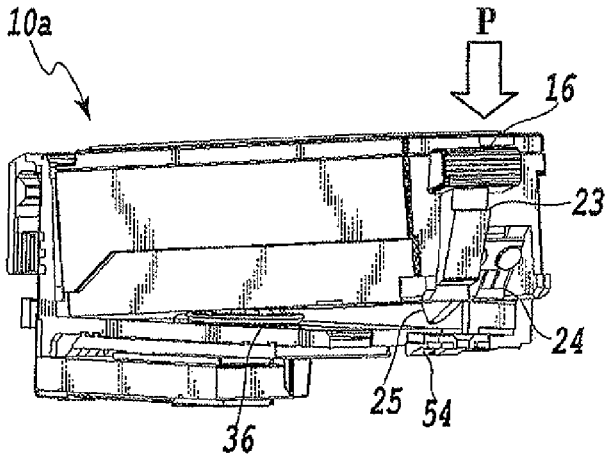
FIG. 9A is a perspective view for explaining tilt at the time of attaching the black ink tank according to the embodiment.
Figure 9B:
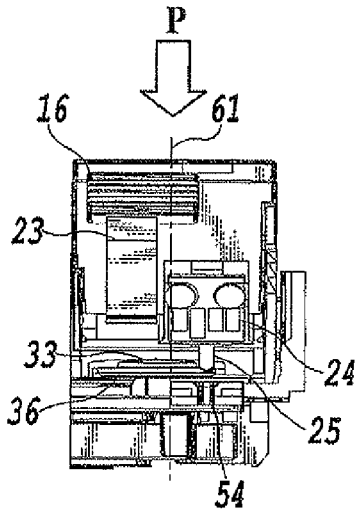
FIG. 9B is a front view of an initial stage of an attachment operation of the black ink tank according to the embodiment, viewed from a board provided on the tank.
Figure 9C:
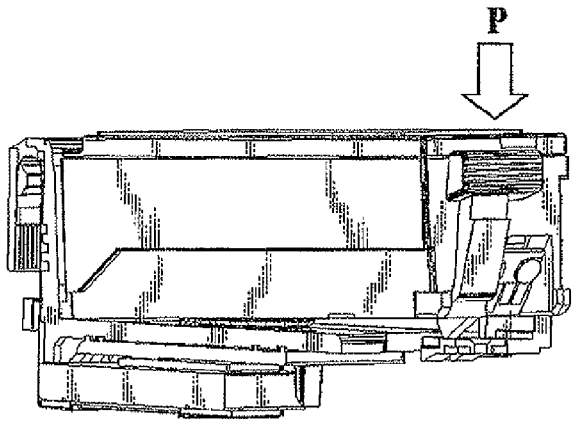
FIG. 9C is a perspective view for explaining tilt in a final stage of the attachment operation of the black ink tank according to the embodiment.
Figure 9D:
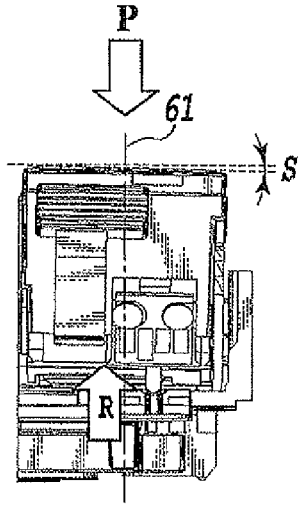
FIG. 9D is a front view of the final stage of the attachment operation of the black ink according to the embodiment, viewed from the board provided on the tank.

FIGS. 9A to 9D are views for explaining the attachment operation. Here, FIGS. 9A and 9B show an initial state of the attachment operation (before the ink supply port abuts the ink receiving pipe and the surrounding sealing member). FIG. 9A shows the ink tank 10*a* viewed from a sideway direction, and FIG. 9B is a front view thereof. FIGS. 9C and 9D show a final state of the attachment operation (when the ink supply port starts abutting the ink receiving pipe and the surrounding sealing member). FIG. 9C shows the ink tank 10*a* viewed from a sideway direction, and FIG. 9D is a front view thereof. Note that FIGS. 9A to 9D illustrate only the attachment section of the black ink tank 10*a*.

As apparent from FIGS. 9A and 9B, in the initial stage of the attachment operation, the ink tank 10*a* does not receive the reactive force from the ink receiving pipe 33 and the sealing member 36. A force from upward for the purpose of attachment is evenly applied to the ink tank 10*a* in the direction indicated with an arrow P in the drawings.

By continuing the operation to attach the ink tank further from this state, the ink supply port located on the bottom face of the ink tank starts abutting the ink receiving pipe and the sealing member as shown in FIGS. 9C and 9D. Accordingly, the ink tank receives the reactive force R shown in FIG. 9D. Since the abutting center of the ink supply port is deviated from the center line 61 as shown in FIG. 8, the ink tank is tilted in the amount of inclination indicated with S in FIG. 9D toward the direction where the ink receiving pipe and the sealing member are absent. In FIGS. 9A to 9D, the abutting center 63 of the ink supply port is positioned at the left side relative to the center line 61 of the tank, while the board attachment positioning section 25 is positioned at the right side. On the contrary, in FIG. 8, the abutting center 63 of the ink supply port is positioned at the right side relative to the center line 61 of the tank, while the board attachment positioning section 25 is positioned at the left side. However, in the present invention, it is only necessary to dispose the abutting center of the ink supply port on the opposite side of the center line of the tank to the board attachment positioning section. In each case, by applying the foregoing configuration, the inclination S of the tank is generated when the tank is attached.

In this way, as the ink tank 10*a* is caused to incline in the course of the attachment operation, the board attachment positioning section 25 located on the tilted side approaches the board-contact positioning section 54. Accordingly, it is possible to allow the positioning sections for electric connection to contact each other promptly, and thereby, possible to achieve more stable attachment.

Moreover, in this embodiment, the latch lever 16 including the second engagement section 23 is disposed on the opposite side of the board attachment positioning section 25 while having the center line 61 in-between. According to this configuration, in the process of the operation to attach the ink tank, the engagement between the positioning sections 24 and 52 for electric connection, which are located on the back side compared to the second engagement section 23 in the engagement direction, occurs before the second engagement section 23 is engaged with the second fitting section 51, as shown in FIGS. 7A to 7C. Accordingly, the ink tank 10*a* receives a reactive force through the board attachment positioning section 25 before the second engagement section 23 is coupled with the second fitting section 51. As a consequence, as similar to the above-described case regarding abutment of the contact sections for ink supply, the ink tank 10*a* is then tilted so that the second engagement section 23 approaches the side of the second fitting section 51. In this way, the attachment property of the ink tank is improved.

In this embodiment, the board attachment positioning section 25 is disposed in the space between the ink supply port 14 and the board 24 on the bottom face of the ink tank 10*a*. In this way, even if the ink spills out of the ink supply port 14 during the operation to attach the ink tank or the like, it is possible to utilize the board attachment positioning section 25 as a barrier and thereby to prevent adhesion of the ink to the board 24.

Next, the color ink tank 10*b* will be described in detail with reference to FIG. 10.

Figure 10:
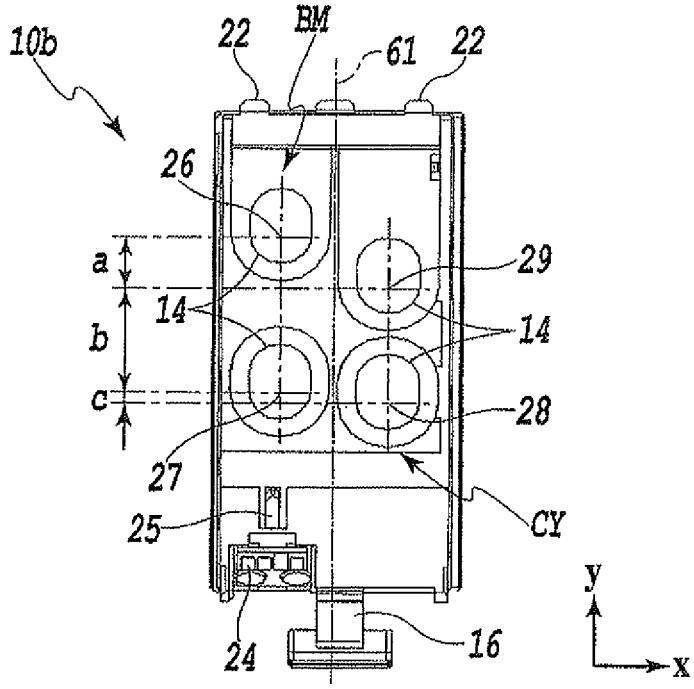
FIG. 10 is a bottom view of the color ink tank according to the first embodiment.

FIG. 10 is a bottom view of the color ink tank 10*b* of this embodiment. The supply ports for the cyan, yellow, magenta, and photo black inks are provided on the bottom face of the color ink tank 10*b* so as to correspond to the partitions of the ink containers (FIG. 5) for the respective colors. Abutting centers when the respective ink receiving pipes 33 abut these ink supply ports 14 for the respective inks in photo black, magenta, yellow and cyan are designated by reference numerals 26, 27, 28, and 29, and are each indicated as intersections of broken lines in the drawing.

As apparent from FIG. 10, each of the ink supply ports is formed into an oblong shape extending in the direction of tank insertion (the y direction) relative to the corresponding abutting center. In this way, it is possible to avoid the ink receiving pipe from contacting the tank bottom face wall at the time of an operation to attach or detach the ink tank.

The ink supply ports 14 are two-dimensionally arranged as follows. First, as apparent from the drawing, the abutting centers of the respective ink supply ports 14 are arranged so as not to be on the same line orthogonal to the y direction. To be more precise, in terms of the y direction, the abutting center 26 of the photo black ink supply port is located in the backmost position. Then, the abutting center 29 of the cyan ink supply port is located in front of the abutting center 26, and the abutting center 27 of the magenta ink supply port is located in front of the abutting center 29. Finally, the abutting center 28 of the yellow ink supply port is located in the position closest to the front face. In the x direction (the width direction of the ink tank) orthogonal to the y direction, there is a row BM defined by the abutting centers 26 and 27 of the photo black and magenta ink supply ports. Similarly, there is another row CY defined by the abutting centers 28 and 29 for the cyan and yellow ink supply ports. These two rows, BM and CY, are located so as to have the center line 61 in the width direction of the ink tank therebetween.

By arranging the ink supply ports so as to disperse the abutting centers 26 to 29 in this way, the photo black, cyan, magenta, and yellow ink supply ports are connected to the corresponding ink receiving pipes in this order when the ink tank is rotated and attached. In addition, the ink tank receives the reactive forces from the ink receiving pipes in the order of the ink supply port 26 located on the left side of the center line 61, the ink supply port 29 located in the direction of the right side of the ink supply port 26, the ink supply port 27 located on the left side of the center line 61, and the ink supply port 28 located in the direction of the right side of the ink supply port 27.

Hence, it is possible to avoid reception of the reactive forces to the ink receiving pipes as attaching forces at one time upon connection. This configuration makes it possible to disperse the reactive forces. Moreover, it is possible to achieve stable attachment while suppressing excessive inclination of the tank at the time of attachment.

In this embodiment, concerning relations between the abutting center 26 of the photo black ink supply port located on the backmost side in the direction of attaching the tank and the abutting center 29 of the cyan ink supply port, and between the abutting center 29 and the abutting center 27 of the magenta ink supply port, layout intervals are increased in this order. Specifically, as shown in FIG. 10, assuming that a distance between the abutting center 26 of the photo black ink supply port and the abutting center 29 of the cyan ink supply port is defined as a, and that a distance between the abutting center 29 of the cyan ink supply port and the abutting center 27 of the magenta ink supply port is defined as b, the distances a and b satisfy a relation of $a<b$.

The ink tank is rotated when it is attached. Accordingly, as an ink supply port is closer to the engagement section located on the back side in the direction of inserting the ink tank, i.e. to a rotating center at the time of attachment, it is possible to reduce an operating force at the time of attaching the ink tank due to the principle of leverage. For this reason, the interval between the ink supply ports located near the rotation center is decreased while the interval between the ink supply ports on the front face side, or as farther away from the rotation center, is increased. By laying out the supply ports as described above, it is possible to reduce the operation force to be applied by the user, and to reduce fluctuation in the operating force in the positions of the respective supply ports.

However, since the ink supply ports are dispersed on the left side and the right side relative to the center line 61 in the width direction of the ink tank, it is conceivable that the inclination of the ink tank be increased at the time of the attachment operation along the increase in the intervals between the abutting centers. For this reason, it is desirable to reduce the interval between the ink supply ports on the front face side, i.e. the region located in the most distant position from the rotation center, in light of suppression of rattles from side to side when completing attachment of the tank so as to achieve attachment of the tank reliably.

To be more precise, in this embodiment, the interval between the abutting center 27 of the magenta ink supply port and the abutting center 28 of the yellow ink supply port is set narrower than the rest of the intervals between the abutting centers of other ink supply ports. In other words, assuming that the interval between the abutting center 27 of the magenta ink supply port and the abutting center 28 of the yellow ink supply port is defined as c, the values a, b, and c satisfy a relation of $c<a<b$ as shown in FIG. 10.

In addition, the abutting center 28 of the ink supply port locating closest to the front side of the ink tank among the included ink supply ports (which is the yellow ink supply port in this embodiment) is located more backward in the direction of attachment of the ink tank than the board attachment positioning section 25. Further, the abutting center 28 of this yellow ink supply port is disposed on the opposite side of the board attachment positioning section 25 while having the center line 61 therebetween. At the time of the operation to attach the ink tank, immediately before the board 24 and the contact unit 53 come in contact to each other, the ink tank 10*b* is tilted toward the side where the abutting center is not located (the left side in FIG. 10) relative to the center line 61. This is a similar movement to the inclination S associated with the attachment of the black ink tank 10*a* as described with reference to FIGS. 9A to 9D. By setting the layouts of the respective ink supply ports as described above, it is possible to achieve stable attachment.

Moreover, as similar to the black tank 10*a*, the color ink tank 10*b* also includes the latch lever 16, which is provided with the second engagement section 23, located on the opposite side of the board attachment positioning section 25 while having the center line 61 therebetween. As a consequence, in the case of the color ink tank 10*b* as well, the second engagement section 23 is tilted so as to approach the second fitting section 51. In this way, the attachment property of the ink tank can be improved.

Furthermore, the color ink tank 10*b* also includes the board attachment positioning section 25 which is disposed in a position between the ink supply ports 14 and the board 24 on the bottom face of the ink tank 10*b*. In this way, even if the ink spills out of the ink supply ports 14 during the operation to attach the ink tank or the like, it is possible to utilize the board attachment positioning section 25 as a barrier and thereby to prevent adhesion of the ink to the board 24.

(Second Embodiment)

It is to be noted that the present invention is not limited only to the above-described embodiment, and the invention may apply various modifications.

Figure 12A:
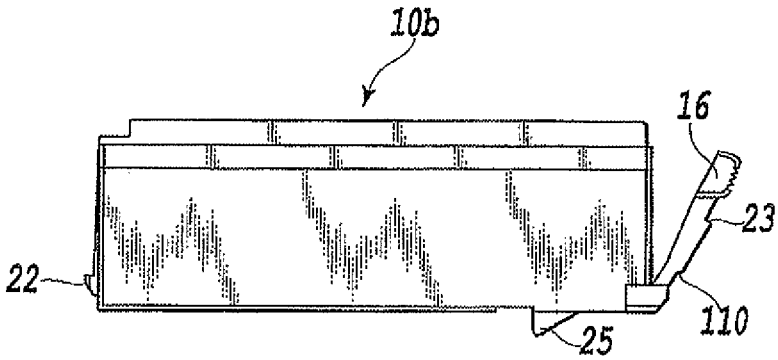
FIG. 12A is a cross-sectional view of an ink tank according to a second embodiment of the present invention.

FIG. 12A shows an ink tank according to a second embodiment of the present invention.

Figure 11:
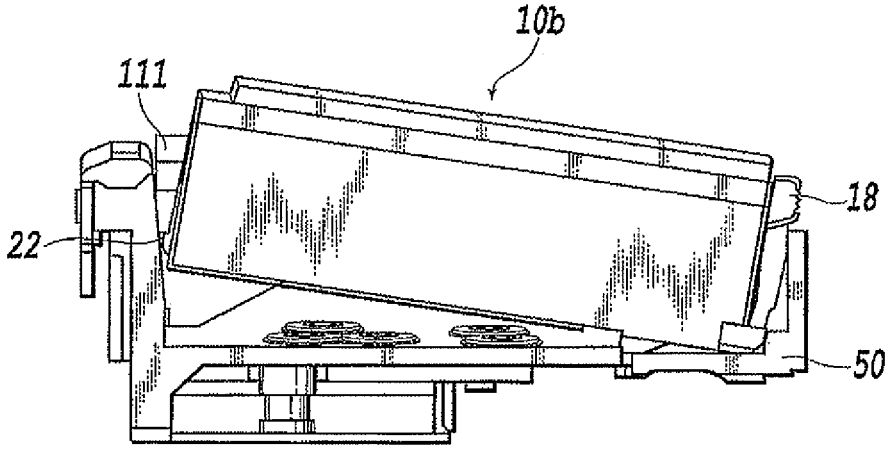
FIG. 11 is a view for explaining a state of incorrectly attaching the ink tank according to the first embodiment.
Figure 12B:
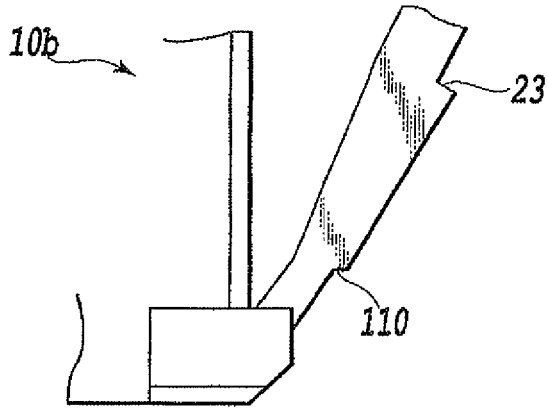
FIG. 12B is an enlarged view of a principal part of the ink tank according to the second embodiment of the present invention.
Figure 13A:
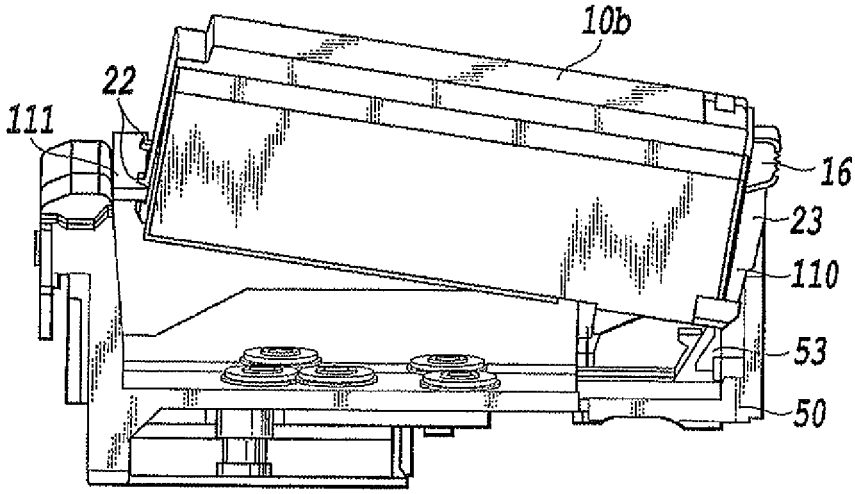
FIG. 13A is a view for explaining that an unfinished state of attachment by use of the ink tank according to the second embodiment.
Figure 13B:
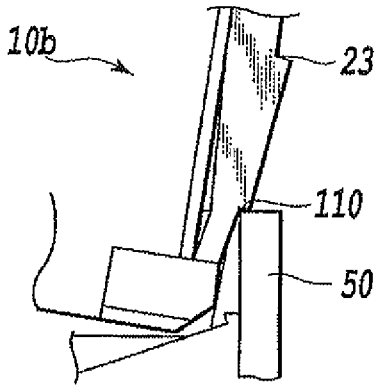
FIG. 13B is an enlarged view of a part of FIG. 13A.
Figure 14A:
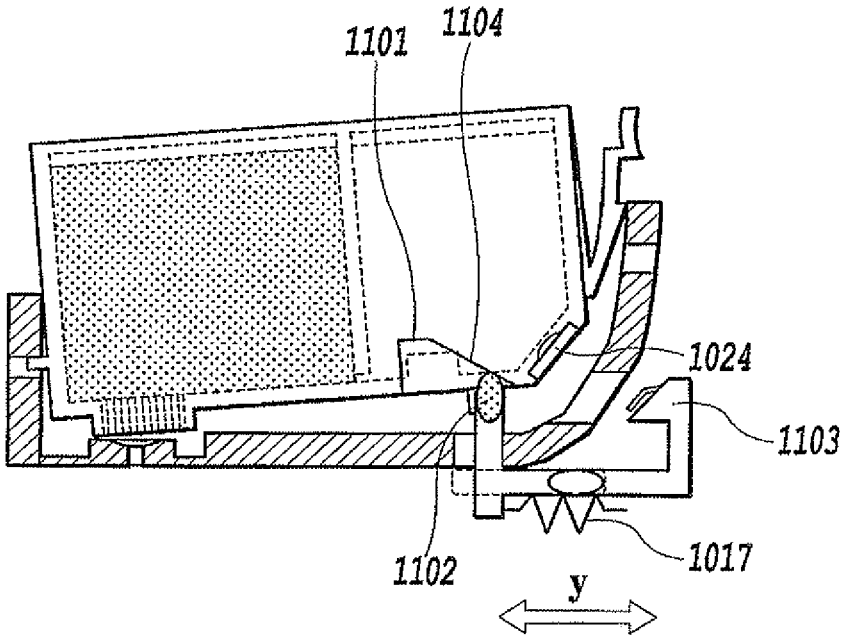
FIG. 14A is a perspective view showing an example of a configuration of a conventional ink tank.
Figure 14B:
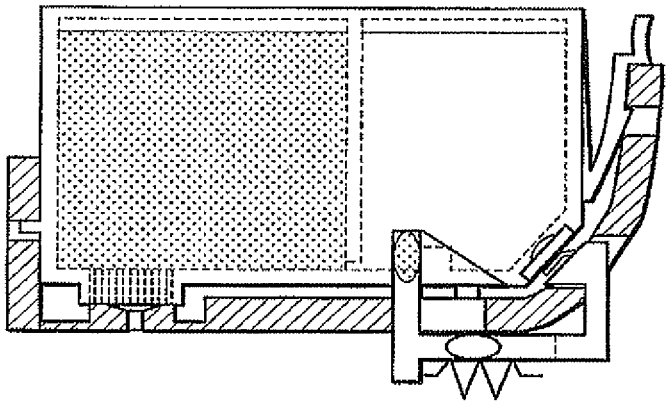
FIG. 14B is a view for explaining a state of attachment of the conventional ink tank.

In a case where an ink tank is attached to the holder unit 50, the ink tank of the first embodiment is configured to insert the first engagement sections 22 provided on the back side of the tank into the first fitting sections 35 of the holder and then to perform a rotating operation around the first engagement sections 22. The holder unit 50 is provided with a guide plate 111 for regulating the direction of insertion so that the back side provided with the first engagement sections is inserted in the first place when attaching the ink tank. The reason for providing the plate is to lead the user to put the first engagement sections provided on the back side of the ink tank below the plate and then to push the latch lever after inserting the back side of the ink tank. Nevertheless, as shown in FIG. 11, a user may start inserting the side of the ink tank provided with the latch lever by mistake. To suppress such incorrect insertion, the ink tank according to the second embodiment includes a step section 110 which is formed on a lower side of the second engagement section provided to the latch lever 16 as shown in FIG. 12B. By providing the step section 110 as shown in FIG. 13A, the back side (where the first engagement sections are provided) of the ink tank abuts the guide plate 111 when the ink tank is inserted to the holder unit 50 from the side where the latch lever is provided. Moreover, as shown in FIGS. 13A and 13B, the step section 110 abuts an upper part of a wall face of the holder unit 50, thereby preventing the latch lever's side of the ink tank from being first to be pushed into the holder unit. The present invention is also applicable to such an ink tank.

Besides the above, the present invention is applicable to various modifications of ink tanks.

For example, the above-described embodiment employs the latch lever in order to attach the ink tank. However, the present invention is effectively applicable to other aspects configured to rotate and attach the ink tank. Accordingly, it is not always necessary to employ the latch lever.

Meanwhile, the embodiment has described the ink tank using the ink absorbers made of the fiber assemblies in order to impregnate and retain the ink and to generate a preferable negative pressure that balances with meniscus retaining forces of the nozzles. However, the ink absorbers are not limited only the fiber assemblies. Meanwhile, it is also possible to separate the ink container into a container chamber including the above-described ink absorber and a container chamber configured to store the ink directly. Moreover, instead of using the ink absorber as negative pressure generating means, it is possible to fill the ink directly into a bag-like member made of an elastic material such as rubber designed to generate tension in a direction of expanding a volume, and to apply a negative pressure to the ink inside by use of the tension generated by this bag-like member. Further, it is also possible to form at least part of an ink containing space by use of an elastic member, then to put only the ink into the space, and to generate a negative pressure by applying a spring force to the elastic member.

Moreover, the embodiments have described the black ink tank for containing the black ink and the color ink tank for containing the yellow ink, the magenta ink, the cyan ink, and the photo black ink. However, the color tones (the colors and densities) of the inks used therein as well as the number of the ink tanks are not limited to this configuration.

Furthermore, the arrangement of the positions of the ink containers for the respective colors of inks as well as ink capacities thereof are not limited to the above-described arrangement or capacities. Particularly, the arrangement of the ink supply ports may be determined irrespective of the ink capacities and the dimensions and shapes of the containers. For example, it is possible to arrange the ink supply ports as described in the present invention even in the case of using the ink containers all having the same capacities and the same dimensions for the above-mentioned four colors.

In addition, the embodiments have described the aspect in which the ink engagement section is separated into the head unit having the inkjet head and the holder unit formed on the body. However, it is possible to render the ink tank detachable by involving only the head unit. Alternatively, it is also possible to fix the head unit to the printing apparatus.

The embodiments of the present invention have described the configuration including the information storage element for storing the information concerning the ink tank. However, the information storage element is not always necessary as long as the ink tank is configured to achieve electric connection with the printing apparatus. For example, it is possible to provide the ink tank with means for notifying an ink residual amount (such as a light emitter) and a contact used for supplying an electric signal to the ink tank for driving the means by control from the printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227176, filed Aug. 23, 2006, which is hereby incorporated by reference herein in its entirety.

What is claimed is:

1. An ink tank attachable to and detachable from an attachment section of an ink jet printing apparatus, the attachment section being provided with an ink receiving section, a first fitting section, a second fitting section and an apparatus-side electric contact, the ink tank comprising:

a housing;

an ink retaining member which is housed in the housing and retains ink;

a supply port configured to abut the ink receiving section;

a board including a tank-side electric contact connectable to the apparatus-side electric contact;

wherein a center of the board is located on one area of two areas defined by dividing the housing by a centerline extending in a longitudinal direction of the housing through a center of width of the housing, and a center of the supply port is located on the other area of the two areas.

2. The ink tank as claimed in claim 1, further comprising:

a first engagement section provided to a first side face of the housing and configured for engagement with the first fitting section of the attachment section; and a resilient member as a second engagement section provided at a second side face opposite to the first side face and configured for engagement with the second fitting section of the attachment section, wherein the resilient member has a base end at the second side face so as to be displaceable with respect to the housing, and has an outwardly-protruded step section at a portion closer to the base end than the second engagement section.

3. The ink tank as claimed in claim 1, wherein the ink tank is attached by rotating around the first engagement section as a hinge.

4. An ink tank attachable to and detachable from an attachment section of an ink jet printing apparatus, the attachment section being provided with a plurality of ink receiving sections, a first fitting section, a second fitting section and an apparatus-side electric contact, the ink tank comprising:

a housing;

a plurality of ink retaining members each of which is housed in the housing and each of which retains ink;

a plurality of supply ports each configured to abut respective ones of the plurality of ink receiving sections; and a board connectable to the apparatus-side electric contact;

wherein each of the plurality of supply ports abuts respective ones of the ink receiving sections, and wherein a center of the board is located on one area of two areas defined by dividing the housing by a centerline extending in a longitudinal direction of the housing through a center of width of the housing, and a center of the supply port provided closest to the board with respect to the longitudinal direction is located on the other area of the two areas.

5. The ink tank as claimed in claim 4, further comprising:

a first engagement section provided to a first side face of the housing and configured for engagement with the first fitting section of the attachment section; and a resilient member as a second engagement section provided at a second side face opposite to the first side face and configured for engagement with the second fitting section of the attachment section, wherein the resilient member has a base end at the second side face so as to be displaceable with respect to the housing, and has an outwardly-protruded step section at a portion closer to the base end than the second engagement section.

6. The ink tank as claimed in claim 4, wherein the respective ink supply ports are disposed on the respective two areas, the ink tank is attached by rotating around the first engagement section as a hinge, and according to the rotation, the plurality of supply ports abut respective ones of the plurality of ink receiving sections in turn, from the ink supply port positioned closest to the hinge with respect to the longitudinal direction of the housing to the ink supply port positioned closest to the attachment positioning section.

7. An ink tank attachable to and detachable from an ink jet printing apparatus, the ink tank comprising:

a housing;

an ink retaining portion which retains ink;

a supply port; and a board;

wherein a center of the board is located on one area of two areas defined by dividing a bottom face of the housing by a centerline extending in a longitudinal direction of the housing through a center of width of the housing, and a center of the supply port is located on the other area of the two areas.

8. The ink tank as claimed in claim 7, wherein the board includes an electric contact connectable to an apparatus-side electric contact.

9. The ink tank as claimed in claim 7, wherein the supply port is formed on the bottom face.

10. The ink tank as claimed in claim 9, wherein the board is arranged inclined toward the bottom face.

11. An ink tank attachable to and detachable from an ink jet printing apparatus, the ink tank comprising:

a housing;

an ink retaining portion which retains ink;

a plurality of supply ports; and a board;

wherein a center of the board is located on one area of two areas defined by dividing a bottom face of the housing by a centerline extending in a longitudinal direction of the housing through a center of width of the housing, and a center of the supply port provided closest to the board with respect to the longitudinal direction is located on the other area of the two areas.

12. The ink tank as claimed in claim 11, wherein the board includes an electric contact connectable to an apparatus-side electric contact.

13. The ink tank as claimed in claim 11, wherein the supply port is formed on the bottom face.

14. The ink tank as claimed in claim 13, wherein the board is arranged inclined toward the bottom face.

* * * * *